United States Patent [19]

Weaver

[11] Patent Number: 4,468,290

[45] Date of Patent: Aug. 28, 1984

[54] APPARATUS FOR ATTACHING A MATRIX TO AN ELECTROFORMING DEVICE AND METHOD THEREFOR

[75] Inventor: Charles A. Weaver, Indianapolis, Ind.

[73] Assignee: RCA Corporation, New York, N.Y.

[21] Appl. No.: 535,712

[22] Filed: Sep. 26, 1983

[51] Int. Cl.[3] ..... C25D 1/10; C25D 17/00; C25D 17/06

[52] U.S. Cl. ..... 204/5; 204/279; 204/281

[58] Field of Search ..... 204/5, 279, 281

[56] References Cited

U.S. PATENT DOCUMENTS

| | | | |
|---|---|---|---|
| 2,905,614 | 9/1959 | Porrata | 204/5 |
| 3,801,476 | 4/1974 | Roschmann | 204/5 |
| 4,309,265 | 1/1982 | Prusak | 204/279 |
| 4,341,613 | 7/1982 | Prusak et al. | 204/281 |
| 4,385,978 | 5/1983 | Prusak | 204/281 |

*Primary Examiner*—Thomas Tufariello

*Attorney, Agent, or Firm*—Birgit E. Morris; Donald S. Cohen; James M. Trygg

[57] ABSTRACT

An improved apparatus for attaching a record matrix to be replicated by electroforming to the cathode of an electroforming device is provided. The apparatus includes a positioning pin which maintains the record matrix center hole concentric to the cathode and to the replicated grooves and a lock knob which effectively holds the center portion of the record matrix in liquid-tight electrical contact with the cathode.

9 Claims, 5 Drawing Figures

APPARATUS FOR ATTACHING A MATRIX TO AN ELECTROFORMING DEVICE AND METHOD THEREFOR

This invention relates to apparatus for attaching a part to be replicated by electroforming to the cathode of an electroforming device. More particularly, this invention is concerned with the knobs and attaching stud which secure the center portion of a record matrix to the cathode of an electroforming device for effecting an electrical contact and seal therewith.

BACKGROUND OF THE INVENTION

In the manufacture of records such as audio records or the newer type of video disc, the initial step in the manufacturing process is to cut a recording of the information desired into a recording substrate. Recordings for audio records are generally cut into a wax or lacquer substrate. Other types of records which have smaller signal elements, such as video discs, are generally cut into metal substrates.

The recorded substrate is then replicated in a matrixing process. The surface of a wax or lacquer recording substrate is activated and then a thin layer of a conductive material is applied to the surface of the substrate as, for example, by electrolytic plating. Thereafter, a metal, typically nickel, is electrodeposited on the recorded substrate until a predetermined thickness of metal is deposited. The electroformed part thus prepared is separated from the wax or lacquer substrate and is used as a master in the subsequent matrixing steps.

The procedure which is used for making replicas from metal recording substrate is slightly different. The surface of the metal recording substrate is passivated to prevent the adhesion of electroplated metal to the metal substrate. Thereafter, a metal such as nickel, is electrodeposited on the surface of the metal recording substrate. When a sufficient thickness of metal has built up on the substrate the resulting electroformed part is separated from the metal recording substrate and is thereafter used as the master in subsequent matrixing steps.

Once the masters are obtained, the matrixing processes employed for further replication are generally similar for various types of records. The masters are mounted on revolvable cathode masks or back plates in an electroforming apparatus. The cathode mask with the master secured to it is immersed into the electrolyte solution and revolved in the solution while a metal is electroformed onto the master. The metal is electroplated onto the master until sufficient thickness of metal is deposited to provide an electroformed part referred to as a mold or mother. The mothers are in turn replicated in an additional electroforming step to form a new series of parts referred to as stampers. The stampers are subsequently used in the pressing of records.

A number of problems have been encountered in the matrixing processes. When the masters are mounted on the revolving back plate to form a mother or when the mothers are mounted on a revolving back plate to form a stamper, it is extremely important that the part which is to be replicated, hereinafter referred to as the matrix, be properly positioned and sealed in a liquid tight fit to the back plate. The matrix must be mounted flush onto the back plate. The outer edge and the center hole of the matrix must be sealed liquid tight to the back plate to prevent electrolyte from flowing behind the matrix.

The problems presented when sealing the center hole are much more difficult to overcome than those presented when sealing the outer edge of the matrix or the back plate since the electrical contact of the cathode to the matrix is made at the center portion of the matrix. The center portion of the matrix should be in full flush contact with the exposed metal surface of the cathode. If full contact is not established and maintained at the center portion, high electrical resistance develops which causes burn outs and treeing about the center hole. The problems encountered in making good electrical contact between the cathode and the matrix are made more difficult because of the relatively small area available for making the electrical connection at the center portion of the matrix. Further a liquid tight seal must be made about the center hole or electrolyte, which is used in the plating bath, will flow through the center hole to the reverse side of the matrix causing plating on the back of the matrix, eventual distortion of the matrix, or electrolyte errosion of the matrix, and eventual damage to the screw threads of the attaching knob and stud that attach the matrix to the cathode.

A further problem arises with respect to centering the matrix on the back plate prior to installing the attaching knob. Since the center hole in the matrix must necessarily be of a larger diameter than that of the attaching stud the center hole must be aligned concentric to the stud. This is currently done by eye. Accurate alignment is important to ensure that good electrical contact is made with the cathode and to prevent leakage of plating solution into the center hole. This alignment has proved to be difficult to perform accurately resulting in poor yield and varying quality.

SUMMARY OF THE INVENTION

According to the present invention an electroforming apparatus is provided having a back plate and cathode arrangement to engage a record matrix for replication thereof. Attaching means is provided for positioning and holding the center portion of the record matrix in liquid-tight electrical contact with the cathode, the center portion containing a concentric center hole therethrough. The attaching means comprises a threaded stud, a positioning pin means, and a locking knob. The threaded stud is rigidly attached to the cathode and is arranged to project through the center hole of the record matrix. The positioning pin means is arranged for positioning the center hole concentric to the threaded stud. The locking knob is arranged in interacting relationship with the positioning pin means for effecting the holding of the center portion of the record matrix in liquid-tight electrical contact with the cathode.

DESCRIPTION OF THE PREFERRED EMBODIMENT

Figure 1:
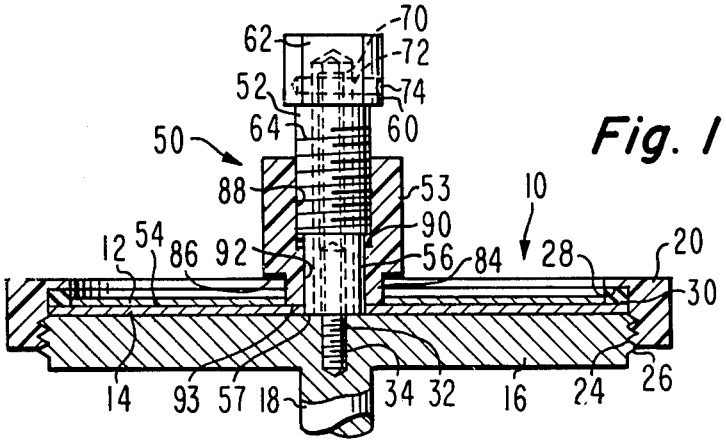
FIG. 1 is a partial cross sectional view of a back plate showing a master and a mother replica thereof and an improved attaching knob embodying the teachings of the present invention.

There is shown in FIG. 1 a cathode head 10 for replicating a mold or mother 12 from a master 14 having a surface relief pattern representing audio and video signal elements. The generation of the relief pattern in the master 14 and creation of the mother 12 are thoroughly described in RCA Review, Volume 39 No. 1, March 1978 and RCA Review, Volume 42 No. 3, September 1981 the methods and materials described therein being well known in the art.

The cathode head 10 includes a disc-shaped back plate 16 made of titanium, a shaft 18 rigidly attached to the back plate 16, and a ring clamp 20 made of a suitable insulating material. The ring clamp 20 has female threads 24 formed therein which threadingly engage male threads 26 formed in the periphery of the back plate 16. An annular shoulder 28 formed in the ring clamp 20 projects radially inwardly as viewed in FIG. 1. An annular ring seal 30 is disposed directly under the shoulder 28 and serves to hold the outer periphery of the master 14 into sealing contact with the back plate 16 thereby preventing plating electrolyte from entering between the master 14 and the back plate 16 causing damage thereto. A threaded stud 32 is rigidly attached to and projects axially outwardly from the back plate 16 as shown in FIG. 1. The stud, having ¼-20 N.C. threads, may either be pressed into a force fit hole 34, or threaded into a similarly threaded hole formed in the back plate 16.

Figure 3:
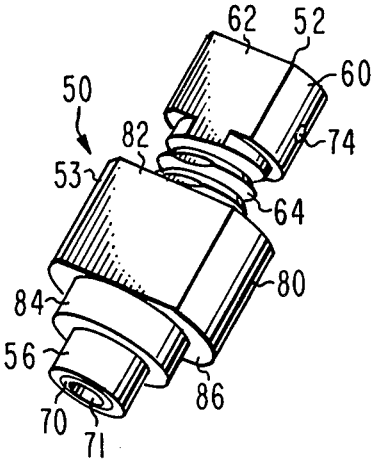
FIG. 3 is an isometric view showing the improved attaching knob of FIG. 1.

A positioning pin and lock knob assembly 50 of the present invention, is shown in FIGS. 1 and 3. The assembly 50 comprises a pin 52 and a lock knob 53 which threadingly interengage to accurately position the master 14 and to hold the center portion 54 of the master 14, or record matrix, in liquid-tight electrical contact with the titanium back plate 16. The plate 16 serves as the cathode during the replication process.

The pin 52 includes a cylindrically shaped locating surface 56 having a length approximately equal to one and one half times its diameter. Opposite the locating surface 56 is a shank or head 60 having a pair of wrench flats 62 formed diametrically opposite thereon. A male threaded portion 64 is formed intermediate the surface 56 and the head 60, having a minor diameter larger than that of the surface 56. A stainless steel threaded insert 70 is axially disposed within the pin 52 for the major part of its length. The insert 70 has a ¼-20 N.C. female thread 71 formed therein for engagement with the stud 32. The insert 70 is prevented from turning with respect to the pin 52 by a steel dowel 72 which projects outwardly from both sides of the insert 70 and into a slightly undersized dowel hole drilled partly through the head 60 as shown in FIG. 1. The steel dowel 72 is shorter than the depth of the hole so that the end of the dowel is recessed below the outer surface of the head 60. A small plastic plug 74 is cemented into the recess using a suitable cement so that the steel dowel 72 is completely isolated from the plating electrolyte. The pin 52 is made of a hardened plastic such as 25% glass filled DELRIN.

The lock knob 53 includes two concentric outside diameters, one being a shank 80 having a pair of diametrically opposite wrench flats 82 formed thereon and the other being a forming diameter 84 terminating in a shoulder 86 and an abutting surface 93. The lock knob 53 is arranged in interacting relationship with the pin 52 in that an axially disposed threaded hole 88, is formed in the head shank 80 and arranged for threading engagement with the male threaded portion 64 of the pin 52. The threaded bore 88, as can be seen in FIG. 1, does not penetrate completely through the lock knob 54 but terminates in an inner shoulder 90. An inner hole 92 is bored the rest of the way through the lock knob 54 concentric with the threaded hole 88. The length of the inner hole 92, that is, the distance from the shoulder 90 to the abutting surface 93 of the lock knob 53 is approximately one half the length of the locating surface 56, however, the length should be sufficient to assure that the shoulders 80 and 90 are separated by a substantial amount to provide adequate strength for the part. While in the present embodiment the forming diameter 84 is shown somewhat smaller than the shank diameter 80, it should be understood that the reverse would work equally as well provided there is sufficient wall thickness to accommodate the threaded bore 88. The lock knob 53 is made of a plastic, such as DELRIN, that is somewhat softer than that of the pin 52 to assure an even sealing engagement between the abutting surface 93 and the matrix.

Figure 2:
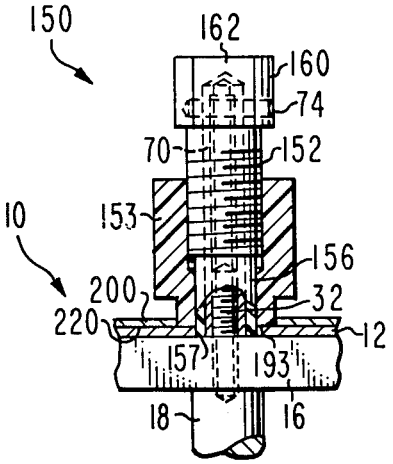
FIG. 2 is a view similar to that of FIG. 1 showing a mother and stamper replica thereof.

There is shown in FIG. 2 a cathode head 10 and a positioning pin and lock knob assembly 150 for replicating a stamper 200 from a mother 12. The various parts shown in the two figures are quite similar, those of the cathode head 10 being identical with identical identifying numbers and those of the lock knob assembly 150 being similar except for their relative scale. The similar parts are indicated in FIG. 2 with a prefix numeral "1" followed by the number of corresponding part in FIG. 1. That is the head 160 shown in FIG. 2 corresponds to the head 60 shown in FIG. 1.

The scale of the lock knob assembly 150 is different because the mother 12, shown in FIG. 1, has a center hole that is formed by the forming diameter 84 of the lock knob 54 which is necessarily larger than the center hole in the master 14. As shown in FIG. 2, the mother 12 now takes the place previously occupied by the master 14 and must be positioned on the back plate in a manner similar to that of the master. Since the center hole in the mother 12 is larger than that of the master 14, it is seen that the locating surface 156, as shown in FIG. 2, must also be larger than the corresponding locating surface 56, as shown in FIG. 1. All other dimensional characteristics of the pin and lock knob assembly 150 are thereby correspondingly larger relative to the surface 156.

Figure 4:
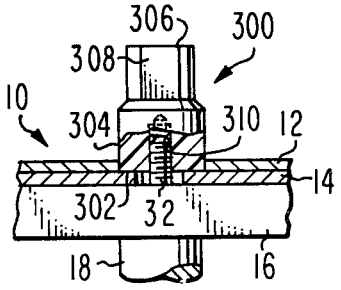
Fig. 4 PRIOR ART
FIG. 4 is a partial cross sectional view of a back plate showing a master, a mother replica thereof, and a prior art attaching knob.
Figure 5:
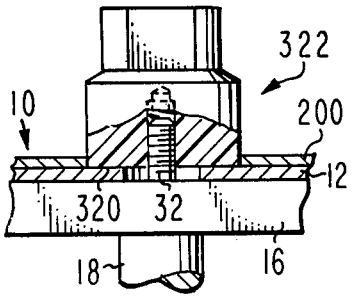
Fig. 5 PRIOR ART
FIG. 5 is a view similar to that of FIG. 4 showing a mother and stamper replica thereof.

Prior to describing the operation of the apparatus of the present invention, the prior art apparatus will be briefly described so that a comparison of the operating characteristics of the two may be presented. FIGS. 4 and 5 illustrate one prior art apparatus serving a function similar to that of the present invention. The cathode head 10 shown in these figures is virtually identical to that of FIGS. 1 and 2 including the back plate 16, shaft 18, threaded stud 32, master 14, mother 12, and stamper 200.

As shown in FIG. 4, a knob 300 having an abutting surface 302, a forming diameter 304, a head 306, and an axially disposed threaded hole 310 is arranged in threading engagement with the threaded stud 32. A pair of wrench flats 308 are formed diametrically opposite on the head 306. Note that there is no means associated with the knob 300 for centering the centerhole of the master 14 and mother 12 with respect to the threaded stud 32. The forming diameter 304 forms the center hole of the mother 12 similar to the forming diameter 84 of the present invention. When the mother 12 is mounted to the back plate 16, again, there is no means provided for centering the center hole with respect to the threaded stud 32, as shown in FIG. 5. Herein lies the significant difference between the prior art case shown in FIGS. 4 and 5 and the case of the present invention shown in FIGS. 1,2, and 3.

In operation in the prior art case, the operator must visually position the master 14 or mother 12 with their respective center holes as concentric as possible with the threaded stud 32 and then tighten the knob 300 securely against the area peripheral to the center hole. This has proven difficult to control, especially in the case of the mother 12, shown in FIG. 5, where the center hole is substantially larger then the diameter of the threaded stud 32. Frequently, the master or mother is so poorly positioned that the abutting surface 302 of the knob 300 or the abutting surface 320 of the knob 322 does not provide a liquid-tight seal when tightened against the master or mother. The consequence of this is quite serious in that plating electrolyte may enter the space between the stud 32 and the wall of the center hole and then invade the area between the master 14, or mother 12, and the back plate 16 thereby damaging these parts. Additionally, the quality of the electrical contact between the master or mother in the vicinity of the center hole with the cathode is compromised. When this occurs, the resulting high electrical resistance may cause burn outs and treeing about the center hole.

It may be suggested by the casual observer that a spacer washer of the proper outside and inside diameters be provided to properly center the master 14 and mother 12 about the stud 32. However, when one considers the fact that the thicknesses of the master 14 and mother 12 are each on the order of 15 mils, it becomes apparent that such a thin spacer would be extremely difficult to handle and would sometimes become wedged under an edge of the matrix being replicated or between the matrix and the abutting surfaces 302, 320 of the knobs 300, 322.

In operation in the case of the present invention, these problems are overcome by providing a positioning pin and lock knob assembly 50 having a pin 52 including a locating diameter, or surface, 56 which slidingly engages the center hole of the matrix 14. The pin 52 is threaded onto the stud 32 and tightened until an abutting surface 57 formed on the end of the pin 52 adjacent the locating diameter 56 engages the back plate 16 in a secure, liquid-tight manner. In this way the center hole of the matrix is very accurately positioned concentric to the stud 32. The lock knob 53 is then screwed downwardly until the abutting surface 92 sealingly engages the upper surface 54 of the matrix 14. This effectively prevents entry of plating electrolyte into the center hole and within the area between the matrix and the back plate 16. Further, since the abutting surface 93 is constructed substantially normal to the locating diameter 56, evenly distributed electrical contact between the matrix 14 and the cathode is effected. Similarly, the positioning pin and lock knob assembly 150, shown in FIG. 2, effectively prevents entry of plating electrolyte into the center hole of the matrix 12 and effects even distribution of electrical contact between the matrix and the cathode.

The important advantages achieved by employing the teachings of the present invention are: (1) electrolyte damage to the threaded stud is prevented; (2) back plating of the matrix to be replicated due to entry of electrolyte between the matrix and the back plate is prevented as well as resulting damage to the back plate itself; (3) low electrical resistance between the matrix and the cathode is maintained thereby preventing burn outs and treeing about the center hole; and (4) the concentricity of the stamper center hole with respect to the video signal grooves replicated on the stamper's surface is greatly improved thereby enhancing the quality of the final product and increasing yield.

I claim:

1. In an electroforming apparatus having a back plate and cathode arrangement to engage a record matrix for replication thereof, attaching means for positioning and holding the center portion of said record matrix in liquid-tight electrical contact with said cathode, wherein said center portion contains a center hole formed therethrough concentric to said matrix, said attaching means comprising:

(a) a threaded stud attachable to said cathode and arranged to project through said center hole of said record matrix;

(b) positioning pin means attachable to said threaded stud for positioning said center hole concentric to said threaded stud wherein said positioning pin means is arranged to pressingly and sealingly engage said cathode while not pressingly engaging said center portion of said record matrix; and (c) a locking knob arranged in interacting relationship with said positioning pin means for effecting said holding of said center portion of said record matrix.

2. The apparatus set forth in claim 1 wherein said positioning pin means includes a cylindrically shaped locating surface dimensioned to slidingly engage said center hole, and a threaded hole formed axial to said locating surface for threading onto said threaded stud.

3. The apparatus set forth in claim 2 wherein said positioning pin means includes a male threaded portion formed axial to said locating surface, and said locking knob includes a female threaded portion for threading onto said male threaded portion and an abutting shoulder formed normal to the axis of said female threaded portion and arranged to pressingly and sealingly engage said center portion of said record matrix.

4. The apparatus set forth in claim 3 wherein either one of said positioning pin means and said locking knob includes a wrench engaging surface for imparting axial turning movement thereto.

5. Apparatus for positioning and holding a record matrix having a center hole formed therethrough, in liquid-tight electrical contact with a cathode having a threaded stud projecting therefrom through said center hole of said record matrix said apparatus comprising:

(a) positioning pin means attachable to said threaded stud for positioning said center hole of said record matrix concentric to said threaded stud wherein said positioning pin means is arranged to pressingly and sealingly engage said cathode while not pressingly engaging said center portion of said record matrix; and (b) a locking knob arranged in interacting relationship with said positioning pin means for effecting said holding of said record matrix.

6. The apparatus set forth in claim 5 wherein said positioning pin means includes a male threaded portion formed axial to said locating surface, and said locking knob includes a female threaded portion for threading onto said male threaded portion and an abutting shoulder formed normal to the axis of said female threaded portion and arranged to pressingly and sealingly engage said center portion of said record matrix.

7. The apparatus set forth in claim 6 wherein either one of said positioning pin means and said locking knob includes a wrench engaging surface for imparting axial turning movement thereto.

8. In a method for positioning and holding an article having a center hole formed therethrough in liquid-tight electrical contact with a conducting member having a threaded stud projecting therefrom, the steps of:

(a) placing said article into contact with said conducting member, said center hole being concentric to said stud;

(b) threading onto said stud a positioning pin having an external threaded portion and a locating surface that closely engages said center hole thereby maintaining said center hole of said article concentric to said stud; and (c) turning a knob having an abutting surface and an internal threaded portion that is in threading engagement with said external threaded portion of said positioning pin until said abutting surface pressingly engages said article thereby forming a liquid-tight electrical contact between said conductivity member and said article.

9. The method set forth in claim 8 wherein said article is a record matrix to be replicated by electroforming and said conducting member is a cathode.

* * * * *